US005472047A

United States Patent [19]

Welkey

[11] Patent Number: 5,472,047

[45] Date of Patent: Dec. 5, 1995

[54] MIXED FINNED TUBE AND BARE TUBE HEAT EXCHANGER TUBE BUNDLE

[75] Inventor: Joseph J. Welkey, Houston, Tex.

[73] Assignee: Brown Fintube, Houston, Tex.

[21] Appl. No.: 124,281

[22] Filed: Sep. 20, 1993

[51] Int. Cl.[6] ..... F28F 1/14

[52] U.S. Cl. ..... 165/172; 165/160; 165/162; 165/178

[58] Field of Search ..... 165/172, 183, 165/162, 160, 178

[56] References Cited

U.S. PATENT DOCUMENTS

| | | | |
|---|---|---|---|
| 1,942,676 | 1/1934 | Williams . | |
| 2,547,021 | 4/1951 | Lassiat et al. . | |
| 2,749,600 | 6/1956 | Persson . | |
| 2,828,723 | 4/1958 | Miller . | |
| 2,998,228 | 8/1961 | Huet . | |
| 3,111,168 | 11/1963 | Huet . | |
| 3,144,081 | 8/1964 | Skiba . | |
| 3,249,154 | 5/1966 | Legrand | 165/172 |
| 3,326,282 | 6/1967 | Jenssen | 165/172 |

FOREIGN PATENT DOCUMENTS

| | | | |
|---|---|---|---|
| 1217691 | 5/1960 | France | 165/178 |
| 1499993 | 11/1967 | France | 165/172 |
| 624116 | 1/1932 | Germany | 165/172 |
| 1444347 | 10/1968 | Germany | 165/172 |
| 248417 | 8/1987 | Germany | 165/160 |
| 607717 | 9/1948 | United Kingdom | 165/172 |
| 644651 | 10/1950 | United Kingdom | 165/172 |
| 656519 | 8/1951 | United Kingdom | 165/172 |

*Primary Examiner*—Martin P. Schwadron
*Assistant Examiner*—L. R. Leo
*Attorney, Agent, or Firm*—Bernard A. Reiter; Mark L. Berrier; Guy E. Matthews

[57] ABSTRACT

Disclosed is a heat exchanger tube bundle design that eliminates the need for tube supports or baffles within a heat exchanger tube bundle. The inventive configuration uses a combination of bare tubes and longitudinally finned tubes positioned such that the longitudinal fins act as spacing and supporting means within the tube bundle. The longitudinal fins provide spacing and support substantially along the entire length of the tubes within the bundle and eliminate the need for internal spacing or supporting means. Taking advantage of this inventive design, one can economically construct a tube bundle requiring only external rings to secure the tube bundle.

5 Claims, 3 Drawing Sheets

MIXED FINNED TUBE AND BARE TUBE HEAT EXCHANGER TUBE BUNDLE

BACKGROUND OF THE INVENTION

I. Field of the Invention

This invention relates generally to tubular heat exchangers and, more particularly, to tube arrangements and supports used in heat exchanger tube bundles.

II. Description of Related Art

Tubular heat exchangers typically consist of a collection of pipes or tubes through which a hot fluid flows internally while a cooler fluid flows over the external surface of the tubes. Heat from the internal fluid transfers through conduction to the external surface of the tubes. This heat is then absorbed by the external fluid as it flows along the outer surface of the tubes, thus cooling the internal fluid. The external surface of the tubes acts as a heat transfer surface. Radial or longitudinal fins are often attached to the external surface of the tubes to increase the area of heat transfer surface and increase the tube's overall heat transfer rate.

Several tubes are combined in heat exchanger tube bundles and are typically enclosed in a shell. In the past, tube bundles have been constructed with tube supports or baffles located within the bundle to provide structural support and spacing for the tubes. The tubes must be firmly supported relatively to each other and to the outer shell, but the considerable length of the tubes often makes it impossible to support the tubes in each bundle from only the ends of the tubes. Several supports or baffles are typically located along the length of the bundle to provide the necessary support and spacing for the tubes.

Although these supports and baffles may often help increase the heat exchange rate of the tube bundle by directing fluid over the tube surfaces, these internal structures constrict fluid flow, increasing the pressure drop of the external fluid ("shellside fluid"), and adding to the costs expended pumping the shellside fluid through the bundle. Heat exchanger designers are generally as concerned with the shellside pressure drop as they are with the overall heat transfer rate of the tube bundle because the power required to move the fluid over the surface of the tubes is often a major operating expense. This pumping power expense is directly proportional to the pressure drop. Tube supports and baffles also significantly contribute to the costs of constructing and maintaining a tube bundle. A tube bundle designed without the use of internal tube supports or baffles improves the prior art by reducing shellside pressure drop and reducing the costs of constructing and maintaining a heat exchanger tube bundle.

As mentioned above, radial or longitudinal fins are often attached to the outer surface of the tubes to increase the area of heat transfer surface and increase the tubes' overall heat transfer rate. Although fins increase the heat transfer rate of the tubes, they take up a considerable amount of space in the tube bundle and reduce the number of tubes that can fit within a given tube bundle's cross sectional area. Tubes with very short fins ("low fins") can be used to maintain a small tube-to-tube distance ("tube pitch") and increase the number of tubes that will fit within a given shell size, but these low fin tubes are very expensive. Low fin tubing has fins embedded into the tube surface in a helical pattern. These fins cannot be used in tube bundles where low shellside pressure drop is required because low fin tubes with longitudinal fins are not available. Longitudinal fins are used in tube bundles where low shellside pressure drop is required because the fin surfaces are parallel to the direction of external fluid flow. A common method of constructing finned tubes is by welding or soldering fins onto bare tubes. Tubes that are constructed with welded-on or soldered-on fins cannot be finned with very low fins because of the difficulty of forming low fins and attaching the fins to the tubes.

Heat exchanger designers using finned tubes are therefore continuously plagued with the problem of being forced to reduce the total number of tubes installed in a given sized shell in order to take advantage of the increased heat transfer surface area provided by the addition of the fins.

By mixing finned and bare (non-finned) tubes in a tube bundle, I have discovered that it is possible to economically construct a tube bundle with a number of welded-on or soldered-on fintubes and still maintain a small tube pitch, thereby adding heat transfer surface without reducing the number of tubes in the bundle. The use of longitudinal fins with no spacing between the fins and adjacent bare tubes additionally allows the longitudinal fins to act as supporting means along the length of the tubes. Mixing finned and bare tubes also significantly reduces the cost of producing the heat exchanger tube bundle because of the reduced manufacturing costs of plain tubes.

Although some past heat exchanger designs have used a mixture of finned and bare tubes, none have disclosed the use of the finned tubes to act as supporting means. Two examples of prior patents that disclose the use of a mixture of finned and bare tubes are U.S. Pat. No. 3,111,168, issued to André Huet in 1963, and U.S. Pat. No. 2,828,723, issued to Avy L. Miller in 1958. Although both issued patents disclose the use of a combination of finned and bare tubes, the inventions are limited to the use of the finned tubes as baffles to direct the flow of shellside fluid and increase heat exchanger performance. For example, in the Huet patent, the finned tubes are positioned so that the fins direct fluid flow and force it to bathe the surface of the plain tubes. In the Miller patent, the unfinned tubes are positioned to act as baffles, directing the flow of hot flue gasses in a water heater to bathe the surface of the finned tubes.

No prior art designs have taken advantage of the use of a mixture of finned and bare tubes in which longitudinal fins provide support for the bare tubes substantially along the entire length of the tubes. Such a design with a mixture of finned and bare tubes reduces the costs of producing the tube bundle and eliminates the need for internal tube supports or baffles that increase shellside pressure drop.

SUMMARY OF THE INVENTION

The present invention is a heat exchanger tube bundle design that uses a combination of bare tubes and longitudinally finned tubes positioned such that the longitudinal fins act as spacing and supporting means within the tube bundle. The longitudinal fins provide spacing and support for the tubes within the bundle and eliminate the need for internal spacing or supporting means. Taking advantage of this inventive design, one can economically construct a tube bundle requiring only external rings to secure the tube bundle.

One object of the invention is to provide a tube bundle design that eliminates the need for tube spacers and supports and minimizes shellside pressure drop. Another object of the invention is to provide a tube bundle design that can pack an optimal number of tubes within a fixed cross sectional area while still taking advantage of the increased heat transfer surface area provided by the use of finned tubes. A further object of the invention is to provide a tube bundle design that is rugged and can withstand the extreme vibrations and external forces that tube bundles are subjected to in industrial operations. Another object of the invention is to provide a tube bundle design with minimal manufacturing complexity and costs. The present invention meets all of these desired objectives while providing a cost effective heat exchanger tube bundle design.

Using the present invention, it is possible to economically construct a tube bundle with a number of welded-on or soldered-on fintubes and still maintain a small tube pitch, thereby adding heat transfer surface without significantly reducing the number of tubes in the bundle. The use of longitudinal fins with no spacing between the fins and adjacent bare tubes allows the longitudinal fins to act as supporting means along the entire length of the tubes. By eliminating the need for internal spacing and supporting structures, this design minimizes shellside pressure drop and reduces manufacturing complexity and costs. Mixing finned and bare tubes significantly reduces the cost of producing the heat exchanger tube bundle because of the reduced manufacturing costs of plain tubes. A significant portion of the production costs of finned tube heat exchangers is in the process of attaching the fins to the tubes. Finning only a portion of the tubes provides significant cost advantages.

Another advantage of the present invention is the rugged characteristic of the design. Most heat exchanger tube bundle designs typically make use of several supports or baffles periodically spaced along the length of the tube bundle to provide the necessary support and spacing for the tubes. In the present invention, the longitudinal fins are in contact with the bare tubes along the entire length of the tubes. This continuous support makes the tube bundle design more rugged to allow the tube to better withstand the extreme vibrations and external forces that tube bundles are subjected to in industrial operations. This rugged tube bundle can better withstand shocks and vibration from external sources and those generated by fluid flowing around or along the tubes.

BRIEF DESCRIPTION OF THE DRAWINGS

The drawings used to describe the preferred embodiment of the invention are as follows.

DESCRIPTION OF THE PREFERRED EMBODIMENTS

Figure 1:
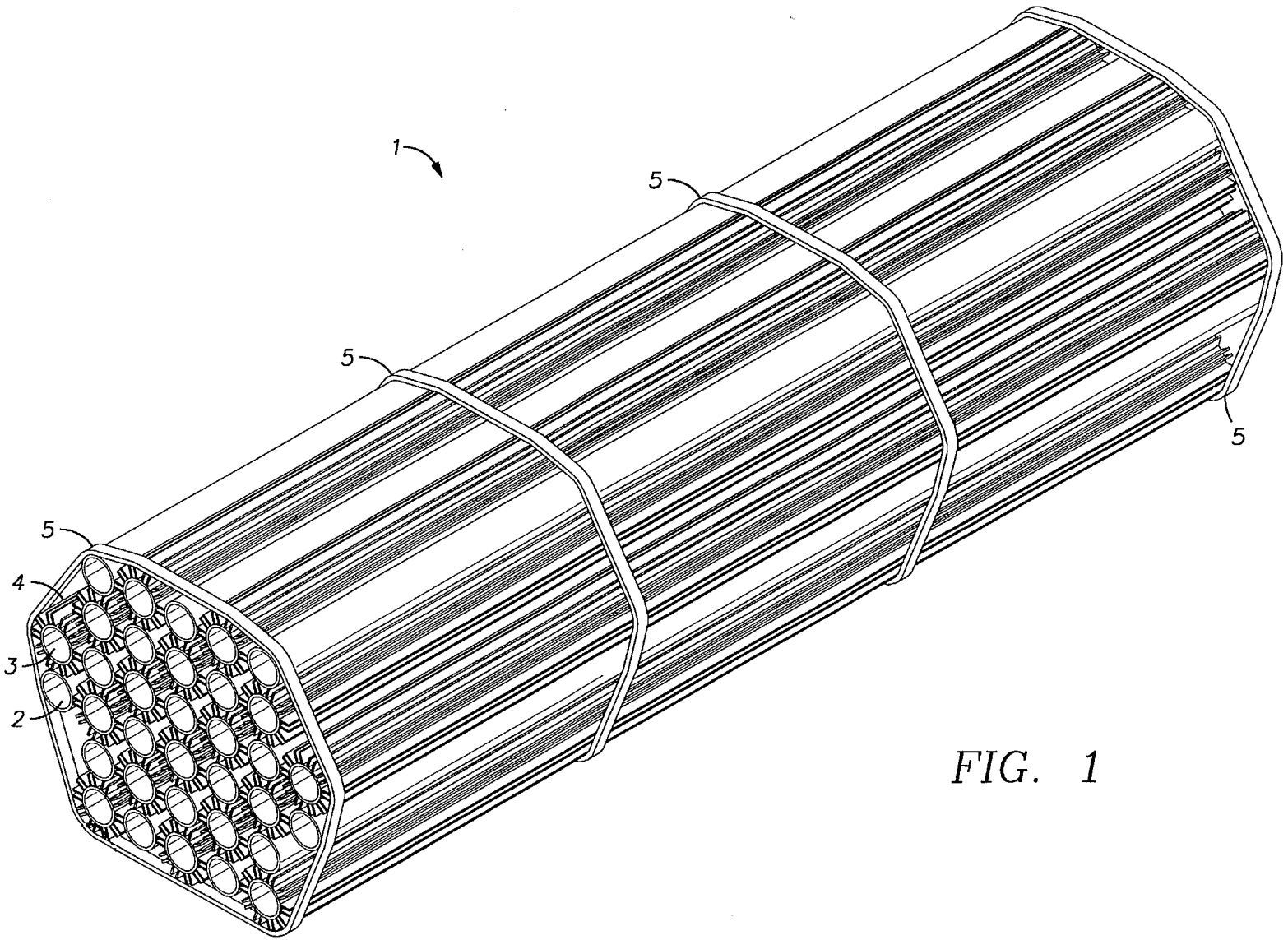
FIG. 1 is an isometric view of the present invention.

As illustrated in FIG. 1, the heat exchanger tube bundle 1 is composed of a combination of bare 2 and finned 3 tubes. The bare 2 and finned 3 tubes are alternated inside the bundle such that the finned tubes 3 longitudinally support each of the bare tubes 2 substantially along the entire length of the tubes. The fins 4 act as spacing and supporting means inside the tube bundle such that no internal supports or baffles are required and the entire bundle can be supported by external rings 5.

Figure 2:
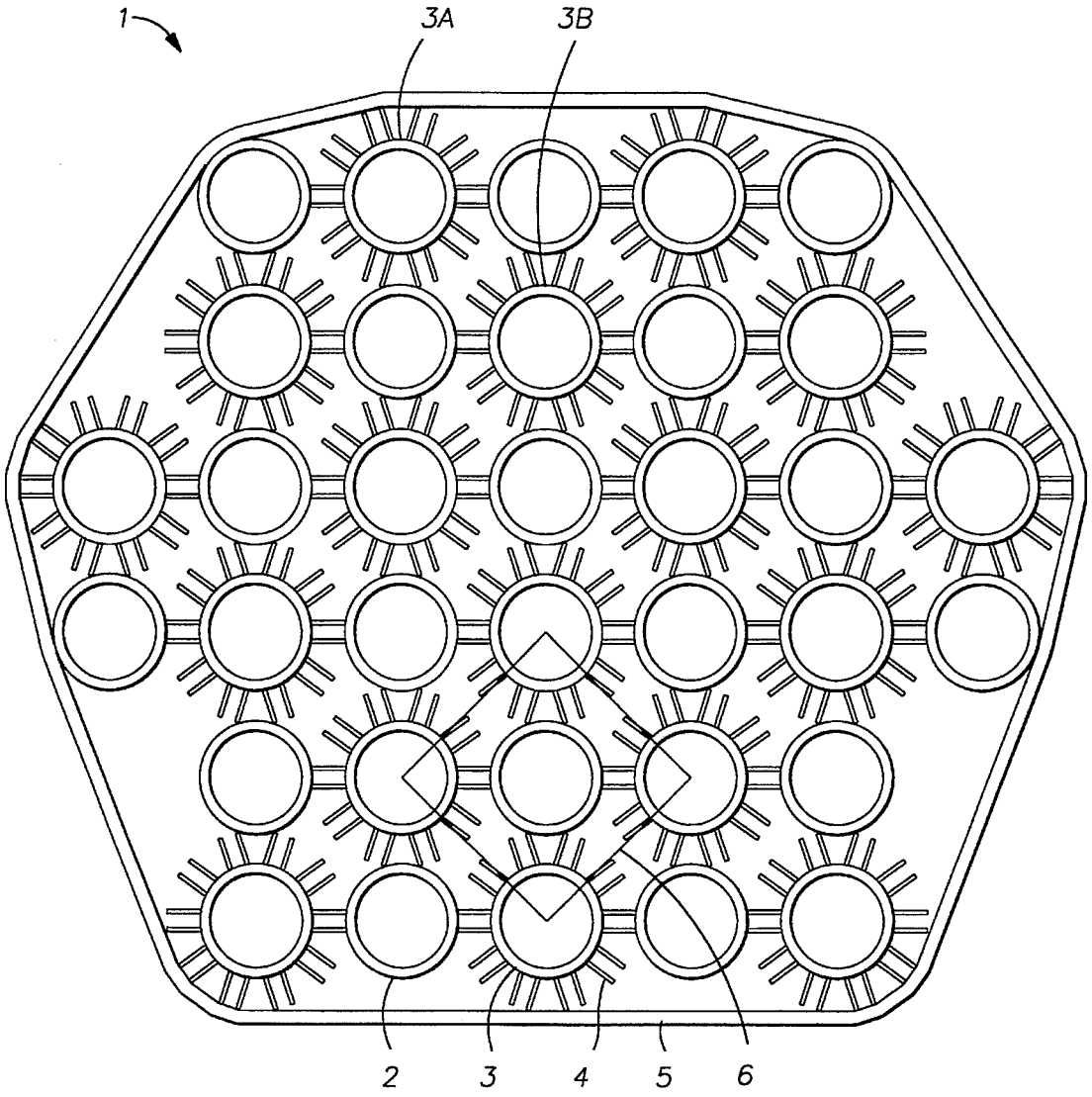
FIG. 2 is a frontal view of the present invention in its rectangular pitch alternative embodiment.

FIG. 2 illustrates one alternative embodiment of the invention in which the tube-pitch is rectangular, resulting in a tube bundle with one-half of the tubes finned 3 and the other one-half bare 2. The rectangular tube pattern 5 is attained by locating a finned tube 3 every second tube only in each row of adjacent tubes and displacing the rows such that each finned tube 3 in adjacent rows is displaced in relation to one another in the direction of the rows by one tube center spacing. For example, as shown in FIG. 2, finned tube e is displaced in relation to finned tube 7 by one tube center spacing in the direction of the rows.

Figure 3:
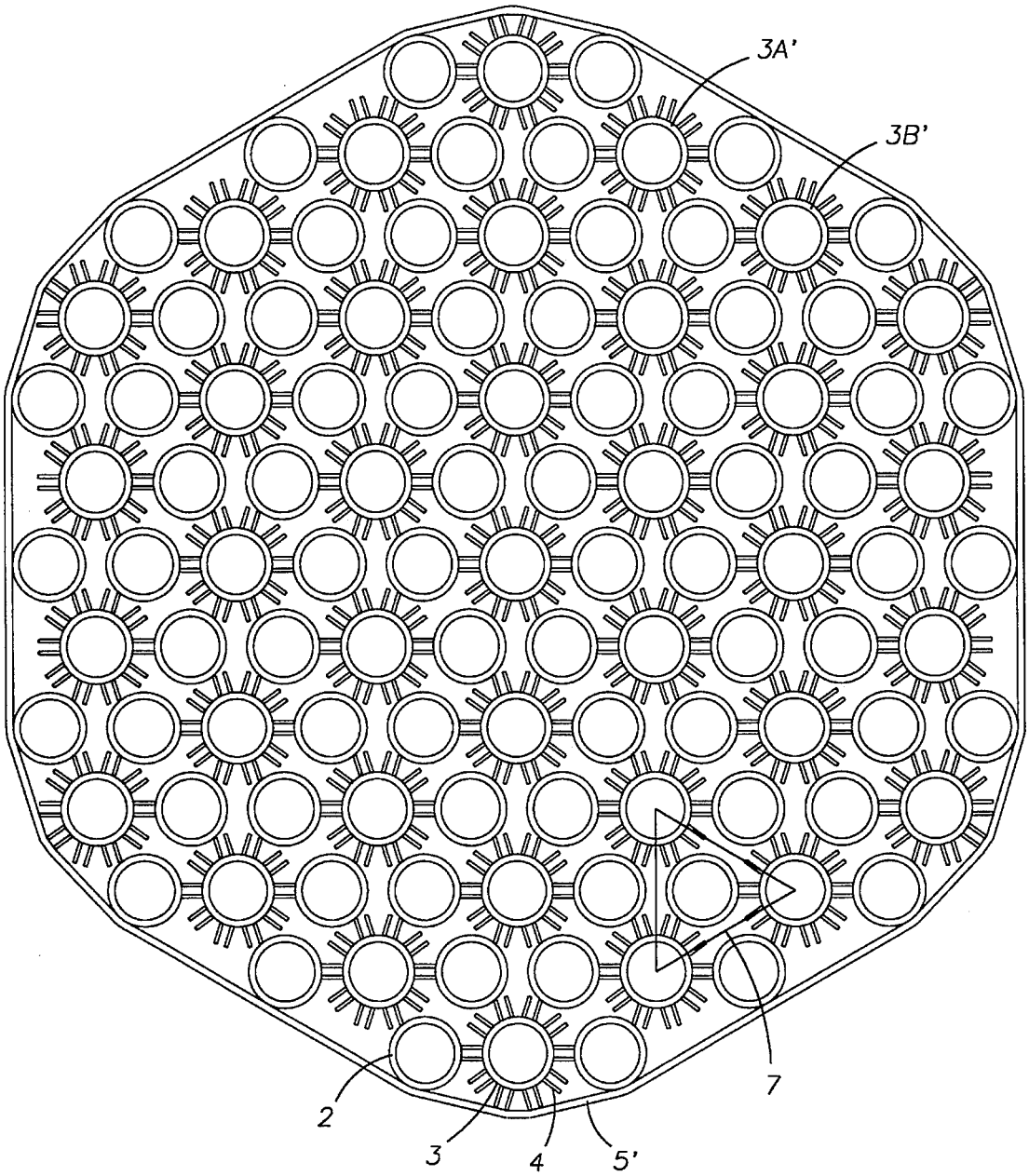
FIG. 3 is a frontal view of the present invention in its triangular pitch alternative embodiment.

FIG. 3 illustrates a second alternative embodiment of the invention in which the tube-pitch is triangular, resulting in a tube bundle with one-third of the tubes finned 3 and the other two-thirds bare 2. The triangular tube pattern 5 is attained by locating a finned tube 3 every third tube only in each row of adjacent tubes and displacing the rows such that each finned tube 3 in adjacent rows is displaced in relation to one another in the direction of the rows by one and a half tube center spacing. For example, as shown in FIG. 3, finned tube 6 is displaced in relation to finned tube 7 by one and a half tube center spacing in the direction of the rows.

While there has been described and illustrated a preferred embodiment of the present invention, it is apparent that one skilled in the art could make numerous alterations and omissions without departing from the spirit of the invention. The materials, dimensions, and relations of the parts may be varied without departing from the scope of the invention. Although the preferred embodiments described provide optimal performance for the heat exchanger tube bundle, various modifications to the embodiments such as alternative tube array configurations may also produce desired performance. The description of the preferred embodiments is intended as being illustrative rather than limiting, since the invention may be variously embodied and the scope of the invention is to be determined as claimed.

I claim:

1. A tubular heat exchanger comprising:

a plurality of bare and finned tubes disposed with their longitudinal axes substantially parallel, said tubes combined to form a tube bundle;

said bare tubes having no fins, and said finned tubes having longitudinally aligned fins extending from their external surfaces for dissipating the heat of hot fluid transmitted through said tubes;

each of said finned tubes positioned between or adjacent to a bare tube, arranged such that said finned tubes provide longitudinal support for said bare tubes, thereby eliminating the need for supporting means within the tube bundle.

2. The tubular heat exchanger of claim 1, said tube bundle having rectangular pitch wherein every second tube only in each row of adjacent tubes is a finned tube and situated one pitch from such finned tubes in adjacent tube rows counted in the row-directions.

3. The tubular heat exchanger of claim 1, said tube bundle having triangular pitch wherein every third tube only in each row of adjacent tubes is a finned tube and situated one and a half pitch from such finned tubes in adjacent tube rows counted in the row-directions.

4. The tubular heat exchanger of claim 1 including no less than one external ring or band surrounding the periphery of said tube bundle, said external ring or band providing support to said tube bundle.

5. The tubular heat exchanger of claim 1 wherein said longitudinally aligned fins on said finned tubes provide support substantially along the entire length of said bare tubes and function as a damping means to absorb and dissipate any vibrations imposed on said tube bundle from external sources or generated by fluid flowing around or along the tubes.

* * * * *